US011056792B2

(12) United States Patent
Xia et al.

(10) Patent No.: US 11,056,792 B2
(45) Date of Patent: Jul. 6, 2021

(54) ANTENNA-IN-PACKAGE SYSTEM AND MOBILE TERMINAL

(71) Applicant: AAC Technologies Pte. Ltd., Singapore (SG)

(72) Inventors: Xiaoyue Xia, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/705,227

(22) Filed: Dec. 6, 2019

(65) Prior Publication Data

US 2020/0212579 A1 Jul. 2, 2020

(30) Foreign Application Priority Data

Dec. 29, 2018 (CN) ..... 201811645892.5

(51) Int. Cl.

*H01Q 9/04* (2006.01)
*H01Q 1/24* (2006.01)
*H01Q 21/06* (2006.01)

(52) U.S. Cl.

CPC ..... *H01Q 9/0435* (2013.01); *H01Q 1/243* (2013.01); *H01Q 21/065* (2013.01)

(58) Field of Classification Search

CPC .... H01Q 9/0435; H01Q 1/243; H01Q 21/065; H01Q 5/35; H01Q 21/08; H01Q 1/22; H01Q 1/2266; H01Q 1/2283; H01Q 1/38; H01Q 1/50; H01Q 5/20

See application file for complete search history.

(56) References Cited

U.S. PATENT DOCUMENTS

2020/0052416 A1* 2/2020 Yong ..... H01Q 21/065
2020/0161749 A1* 5/2020 Onaka ..... H01Q 1/38

* cited by examiner

*Primary Examiner* — Daniel D Chang
(74) *Attorney, Agent, or Firm* — W&G Law Group LLP

(57) ABSTRACT

An antenna-in-package system and a mobile terminal are provided. The mobile terminal includes a main board. The antenna-in-package system includes a substrate, a metal antenna provided on a side of the substrate facing away from the main board, an integrated circuit chip provided on a side of the substrate close to the main board, and a circuit provided in the substrate and connecting the metal antenna to the integrated circuit chip. The circuit is connected to the main board. The metal antenna is a patch antenna simultaneously fed with power by two feeding points. The two feeding points are used to excite electromagnetic waves in different bands. The antenna-in-package system provided by the present disclosure achieves dual-band coverage of 28 GHz and 39 GHz, and a size is reduced to 18×5 mm, so that an occupied area is greatly reduced, and a gain reduction is small.

12 Claims, 9 Drawing Sheets

ANTENNA-IN-PACKAGE SYSTEM AND MOBILE TERMINAL

TECHNICAL FIELD

The present disclosure relates to the field of wireless communication technologies, and in particular, to an antenna-in-package system and a mobile terminal.

BACKGROUND

With 5G being a focus of research and development in global industry, developing 5G technologies and formulating 5G standards have become the industry consensus. The ITU-RWP5D 22nd conference held in June 2015 by International Telecommunication Union (ITU) identified three main application scenarios for 5G: enhance mobile broadband, large-scale machine communication, and highly reliable low-latency communication. These three application scenarios respectively correspond to different key indicators, and in the enhance mobile broadband scenario, the user peak speed is 20 Gbps and the minimum user experience rate is 100 Mbps. Currently, 3GPP is working on standardization of 5G technology. The first 5G Non-Stand Alone (NSA) international standard was officially completed and frozen in December 2017, and the 5G Stand Alone standard was scheduled to be completed in June 2018. Research work on many key technologies and system architectures during the 3GPP conference was quickly focused, including millimeter wave technology. Characteristics of high carrier frequency and large bandwidth that are unique to the millimeter wave are the main means to achieve 5G ultra-high data transmission rates.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. Phases of respective array units are caused to distribute according to certain rule by a phase shifter, so that a high gain beam is formed and the beam is scanned over a certain spatial range through a change in phase shift.

With an antenna being an indispensable component in a radio frequency (RF) front-end system, it is an inevitable trend in future development of the RF front-end to systematically integrate and package the antenna with an RF front-end circuit while developing the RF circuit towards integration and miniaturization. The antenna-in-package (AiP) technology integrates, through package material and process, an antenna into a package carrying a chip, which fully balances antenna performance, cost and volume and is widely favored by broad chip and package manufacturers. At present, companies including Qualcomm, Intel, IBM and the like have adopted the antenna-in-package technology. Undoubtedly, the AiP technology will also provide a good antenna solution for 5G millimeter wave mobile communication systems.

In the related art, since bands of 28 GHz and 39 GHz are far apart, the antenna-in-package cannot cover the two bands. Therefore, the band of 28 GHz and the band of 39 GHz belong two independent channels, which require a large area in space of a mobile phone.

Therefore, it is necessary to provide a new antenna-in-package system to solve the above problems.

BRIEF DESCRIPTION OF DRAWINGS

Many aspects of exemplary embodiment can be better understood with reference to following drawings. Components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
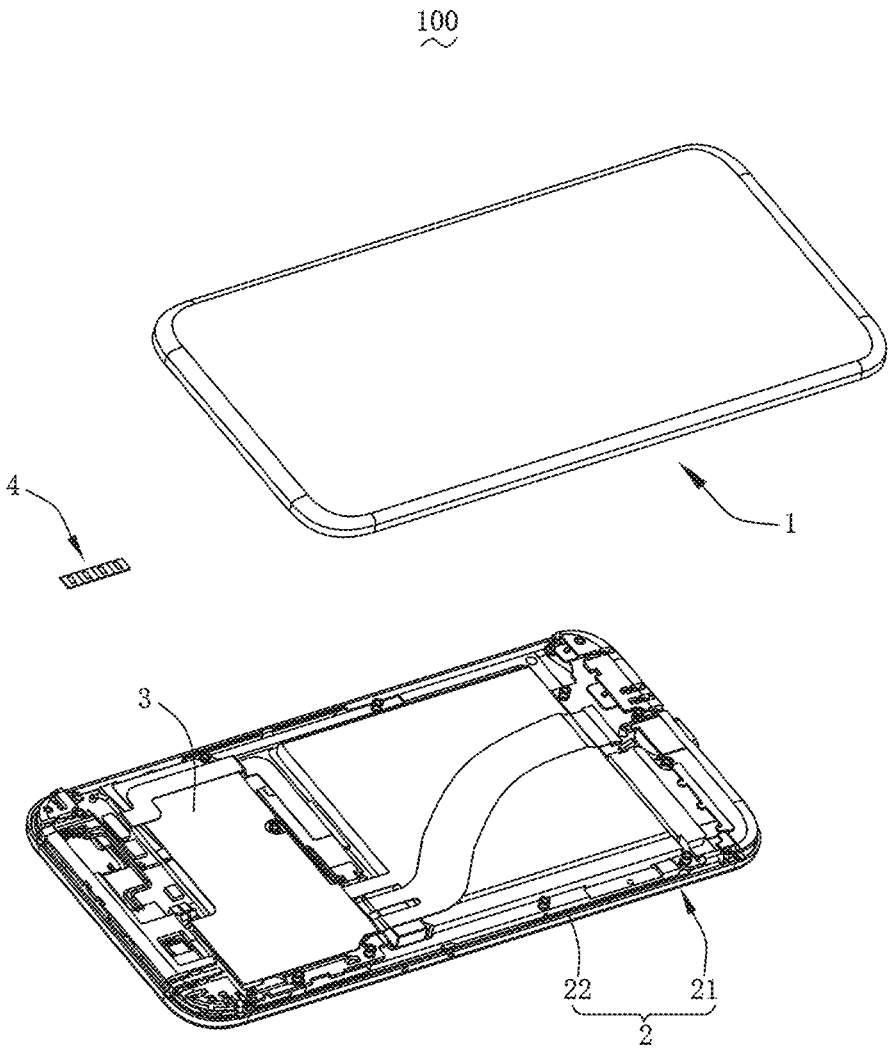
FIG. 1 is a perspective structural schematic diagram of a mobile terminal according to the present disclosure.
Figure 2:
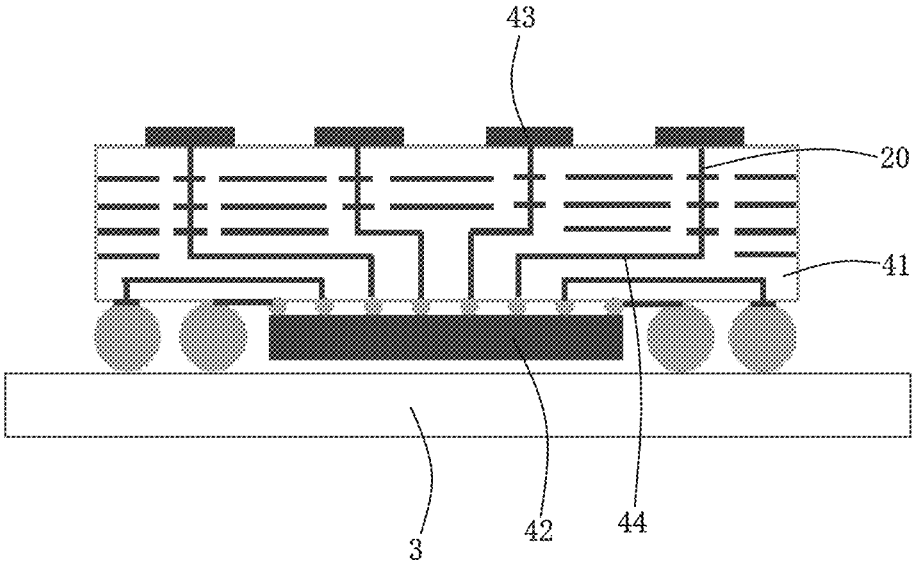
FIG. 2 is a schematic diagram showing a connection structure of an antenna-in-package system and a main board shown in FIG. 1.
Figure 3:
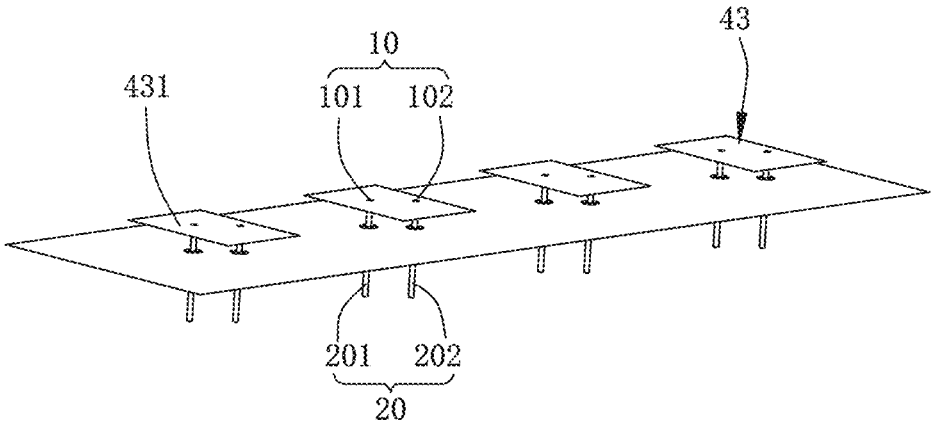
FIG. 3 is a schematic diagram showing a connection structure of a metal antenna unit and a feeding probe.

As shown in FIGS. 1-3, the present disclosure provides a mobile terminal 100, and the mobile terminal 100 may be a mobile phone, an ipad, a POS machine, etc., which is not limited by the present disclosure. The mobile terminal 100 includes a screen 1, a back cover 2 covering, connected to and fitting with the screen 1 to form a receiving space, a main board 3 interposed between the screen 1 and the back cover 2, and an antenna-in-package system 4 connected to the main board 3. The main board 3 and the antenna-in-package system 4 are both received in the receiving space.

The back cover 2 is a 3D glass back cover that can provide better protection, aesthetics, thermal diffusion, color, and user experience. The back cover 2 includes a bottom wall 21 opposite to and spaced apart from the screen 1, and a side wall 22 being bent and extending from an outer periphery of the bottom wall 21 towards the screen 1. The side wall 22 is connected to the screen 1, and the bottom wall 21 and the side wall 22 are formed into one piece.

The antenna-in-package system 4 is provided close to the side wall 22 and parallel to the bottom wall 21. The antenna-in-package system 4 is configured to receive and transmit electromagnetic wave signals, thereby implementing a communication function of the mobile terminal 100. The antenna-in-package system 4 can be connected to the main board 3 by adopting a Ball Grid array (BGA) technology.

The antenna-in-package system 4 includes a substrate 41 provided between the screen 1 and the back cover 2, an integrated circuit chip 42 provided on a side of the substrate 41 close to the main board 3, a metal antenna 43 provided on a side of the substrate 41 facing away from the main board 3, and a circuit 44 provided in the substrate 41 and connecting the integrated circuit chip 42 with the metal antenna 43.

The substrate 41 is configured to carry the metal antenna 43 and the circuit 44. The substrate 41 may be integrally formed or layered. Optionally, the substrate 41 is a multi-layer high-frequency low-loss plate. The integrated circuit chip 42 is fixedly connected to the substrate 41 by a bumping welding process.

The metal antenna 43 is a patch antenna and includes two feeding points 10, and the patch antenna is simultaneously fed with power by the two feeding points 10. The two feeding points 10 are configured to excite electromagnetic waves of different bands. The feeding points 10 include a first feeding point 101 and a second feeding point 102, and the first feeding point 101 and the second feeding point 102 are spaced apart from each other. The first feeding point 101 is configured to excite electromagnetic waves of 28 GHz, and the second feeding point 102 is configured to excite electromagnetic waves of 39 GHz.

The feeding point 10 is connected to the circuit 44 via a feeding probe 20, to feed power to the metal antenna 43. The feeding probe 20 includes a first feeding probe 201 and a second feeding probe 202. The first feeding point 101 is connected to the circuit 44 by the first feeding probe 201, and the second feeding point 102 is connected to the circuit 44 by the second feeding probe 202.

Further, the antenna-in-package system 4 is a millimeter wave phased array system, and the space occupied in the mobile phone is narrowed; and only one perspective needs to be scanned, which simplifies design difficulty, test difficulty, and beam management complexity. The metal antenna 43 is arranged in a one-dimensional linear array and includes a plurality of metal antenna units 431, and the plurality of the metal antenna units 431 is sequentially arranged at intervals. Optionally, the metal antenna 43 is a linear array of 1×4, that is, the metal antenna 43 includes four metal antenna units 431, and each of the metal antenna units 431 includes two feeding points 10.

Further, the metal antenna 43 is a microstrip patch antenna and it is selected from a group consisting of a square patch antenna, a ring patch antenna, a circular patch antenna, and a cross-shaped patch antenna. Optionally, the metal antenna 43 is a square patch antenna. It is appreciated that, in other embodiments, the metal antenna 43 may also use antennas of other forms.

Compared with the antenna-in-package in the related art, in the antenna-in-package system 4 in the present disclosure, the metal antenna 43 includes a first feeding point 101 and a second feeding point 102, and the first feeding point 101 and the second feeding point 102 excite signals of different bands to achieve a dual-band coverage of the antenna-in-package system 4. Moreover, the antenna-in-package system 4 is formed by being laminated by a PCB process or an LTCC process, such that the size is reduced to 18×5 mm and the occupied area is greatly reduced compared with the dual-band antenna system in the related art.

Figure 4A:
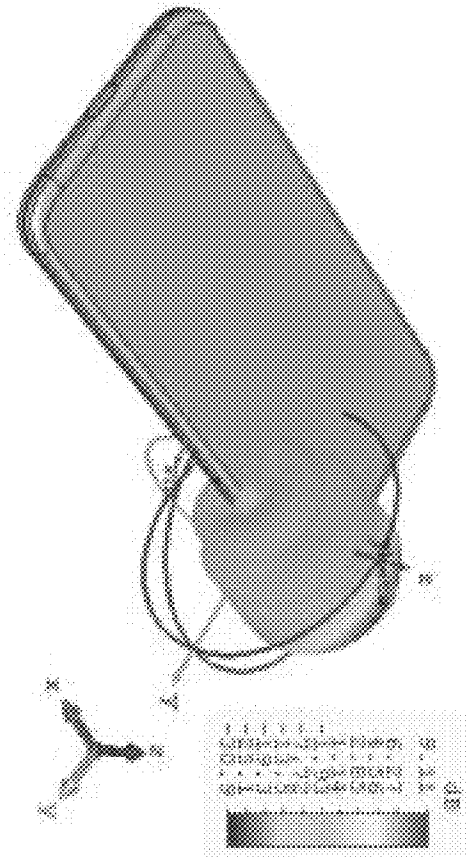
FIG. 4A illustrates a radiation pattern of a metal antenna unit with a phase shift being 45° when an antenna-in-package system according to the present disclosure is in a band of 28 GHz.
Figure 4B:
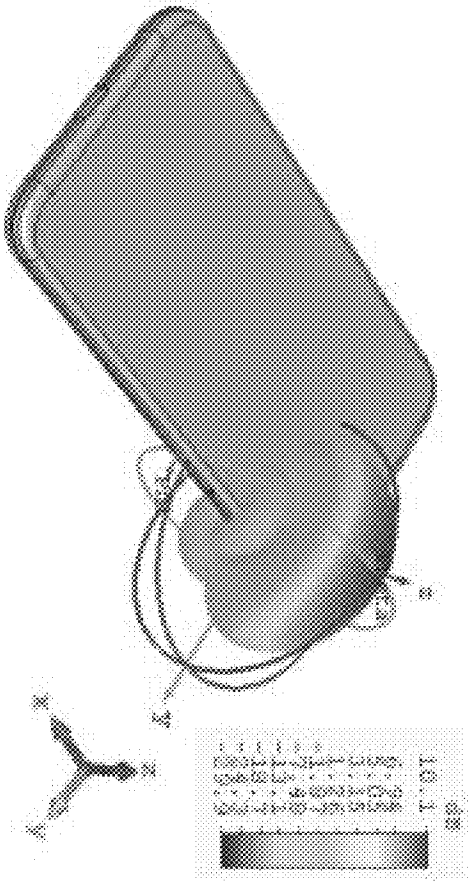
FIG. 4B illustrates a radiation pattern of a metal antenna unit with a phase shift being 0° when an antenna-in-package system according to the present disclosure is in a band of 28 GHz.
Figure 4C:
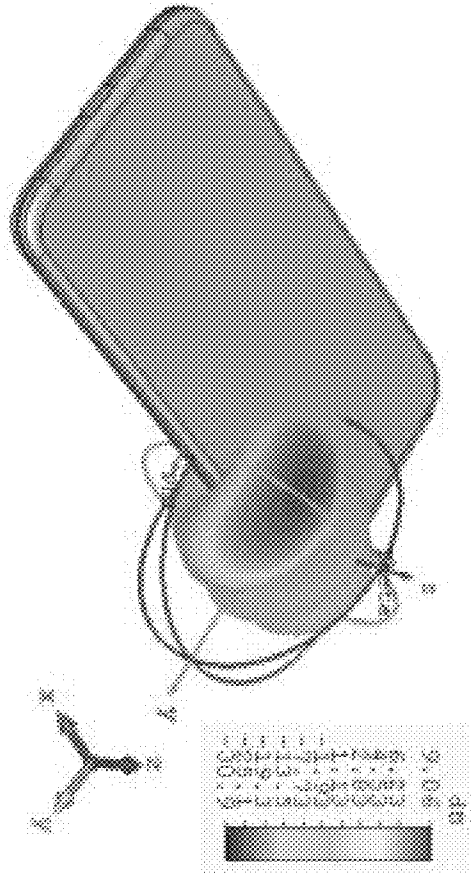
FIG. 4C illustrates a radiation pattern of a metal antenna unit with a phase shift being −45° when an antenna-in-package system according to the present disclosure is in a band of 28 GHz.
Figure 5A:
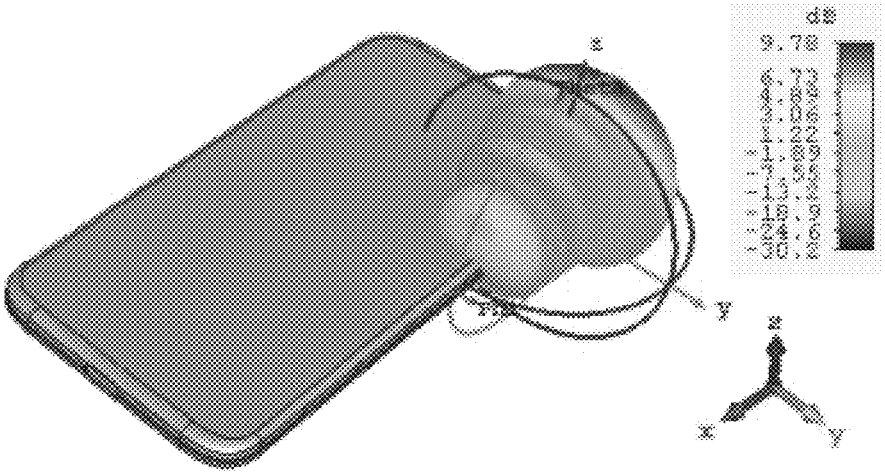
FIG. 5A illustrates a radiation pattern of a metal antenna unit with a phase shift being 45° when an antenna-in-package system according to the present disclosure is in a band of 39 GHz.
Figure 5B:
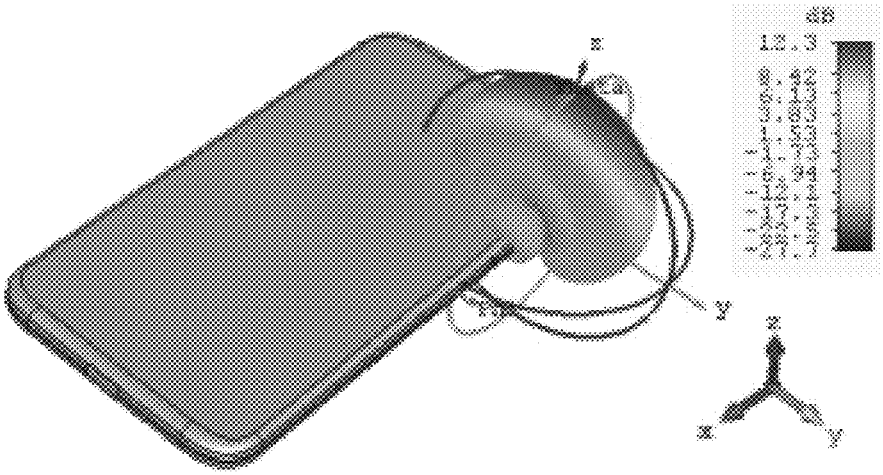
FIG. 5B illustrates a radiation pattern of a metal antenna unit with a phase shift being 0° when an antenna-in-package system according to the present disclosure is in a band of 39 GHz.
Figure 5C:
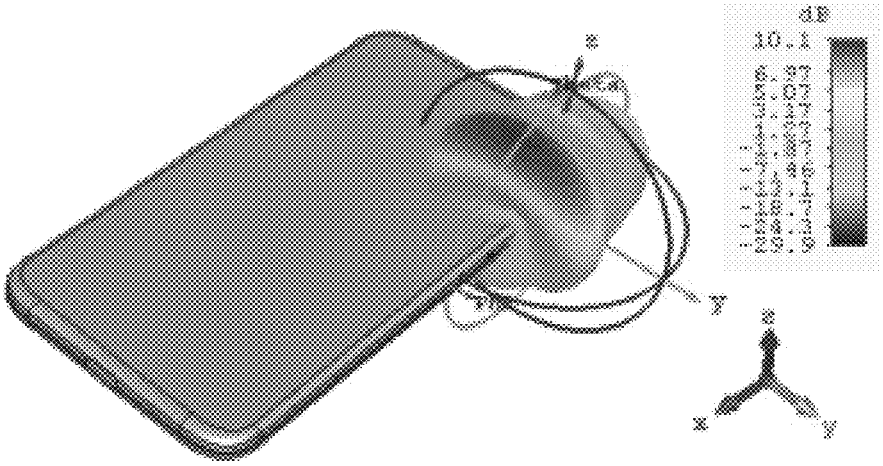
FIG. 5C illustrates a radiation pattern of a metal antenna unit with a phase shift being −45° when an antenna-in-package system according to the present disclosure is in a band of 39 GHz.
Figure 6A:
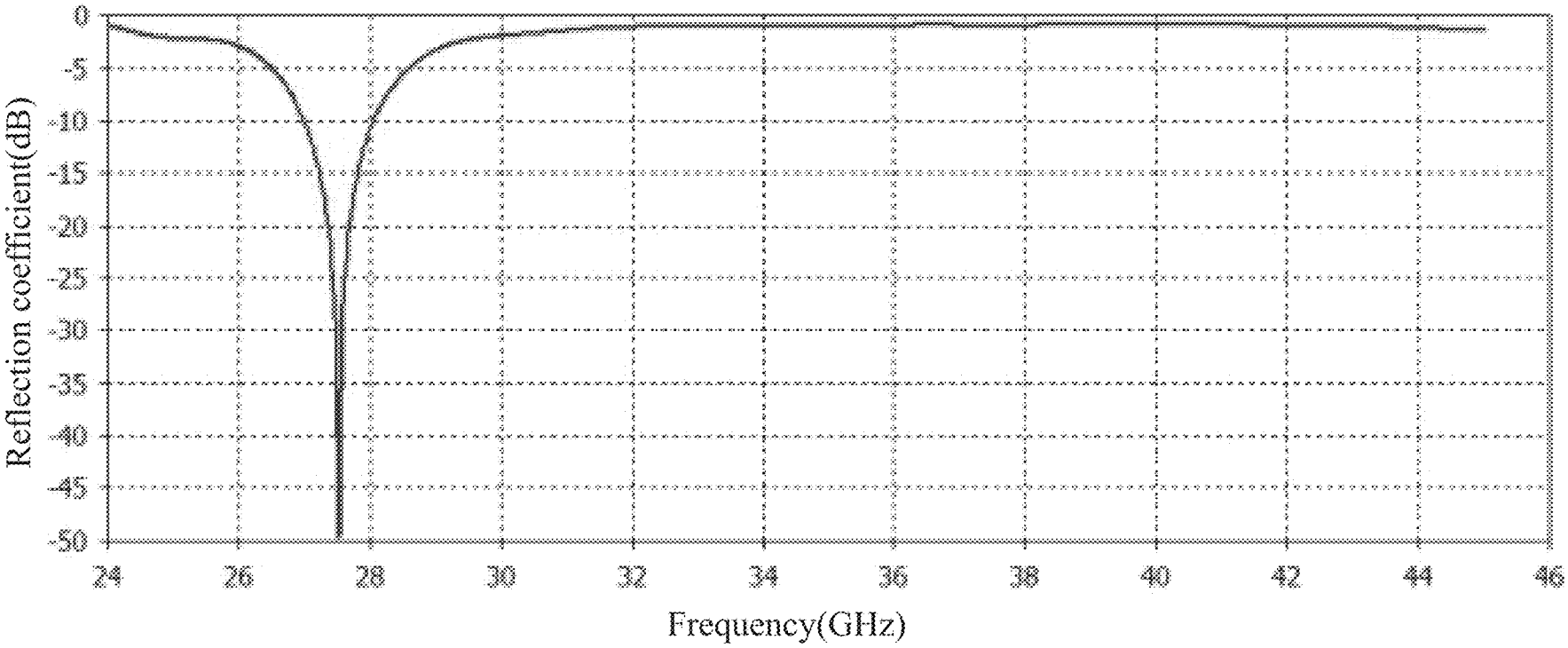
FIG. 6A illustrates a reflection coefficient graph of an antenna-in-package system according to the present disclosure in a band of 28 GHz.
Figure 6B:
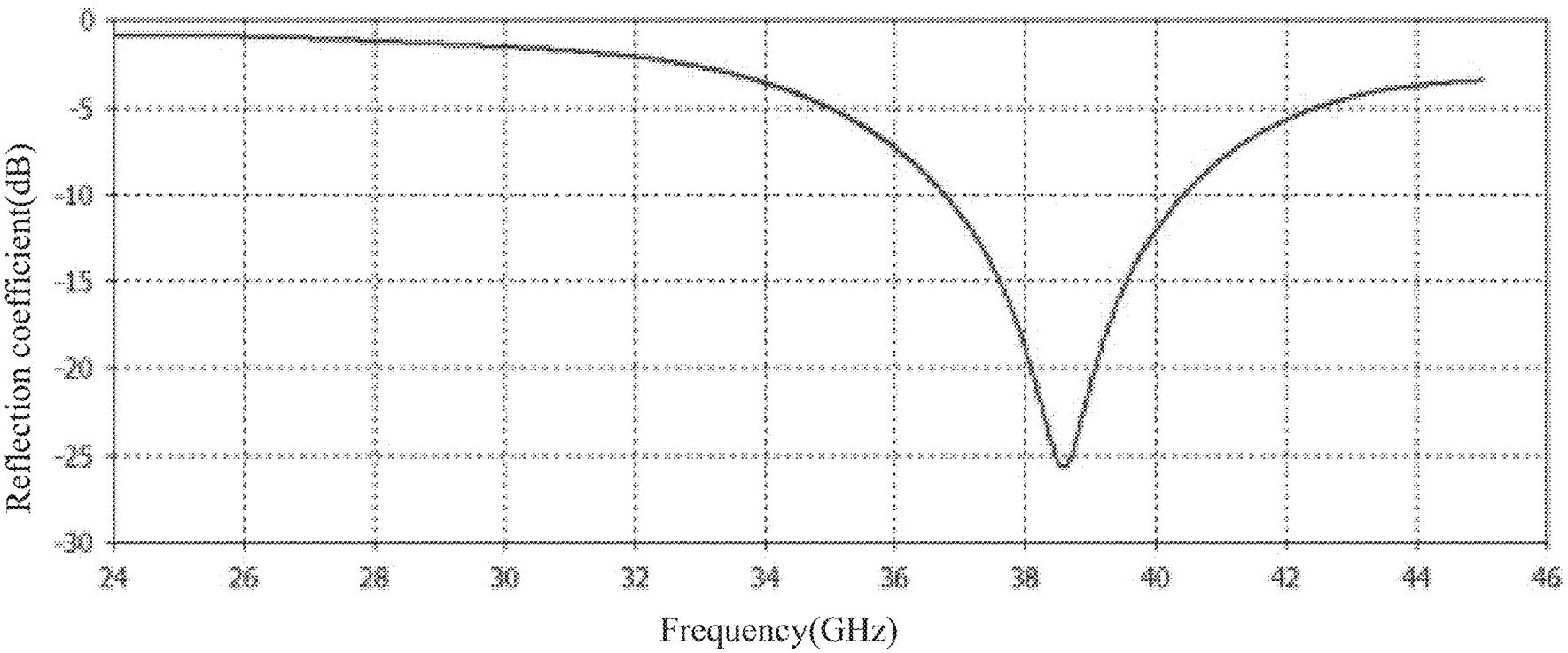
FIG. 6B illustrates a reflection coefficient graph of an antenna-in-package system according to the present disclosure in a band of 39 GHz.

Referring to FIG. 4A~FIG. 7B, in which:

FIG. 4A illustrates a radiation pattern of a metal antenna unit with a phase shift being 45° when an antenna-in-package system according to the present disclosure is in a band of 28 GHz;

FIG. 4B illustrates a radiation pattern of a metal antenna unit with a phase shift being 0° when an antenna-in-package system according to the present disclosure is in a band of 28 GHz;

FIG. 4C illustrates a radiation pattern of a metal antenna unit with a phase shift being −45° when an antenna-in-package system according to the present disclosure is in a band of 28 GHz;

FIG. 5A illustrates a radiation pattern of a metal antenna unit with a phase shift being 45° when an antenna-in-package system according to the present disclosure is in a band of 39 GHz;

FIG. 5B illustrates a radiation pattern of a metal antenna unit with a phase shift being 0° when an antenna-in-package system according to the present disclosure is in a band of 39 GHz;

FIG. 5C illustrates a radiation pattern of a metal antenna unit with a phase shift being −45° when an antenna-in-package system according to the present disclosure is in a band of 39 GHz;

FIG. 6A illustrates a reflection coefficient graph of an antenna-in-package system according to the present disclosure in a band of 28 GHz;

FIG. 6B illustrates a reflection coefficient graph of an antenna-in-package system according to the present disclosure in a band of 39 GHz.

Figure 7A:
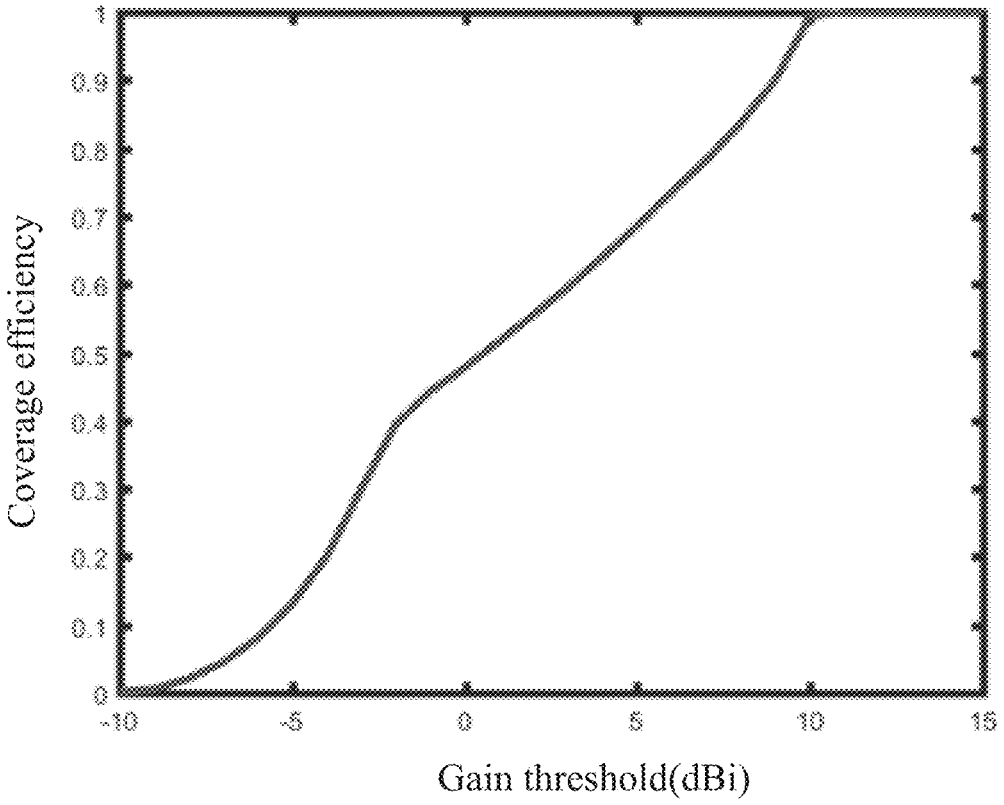
FIG. 7A illustrates a coverage efficiency graph of an antenna-in-package system according to the present disclosure in a band of 28 GHz.
Figure 7B:
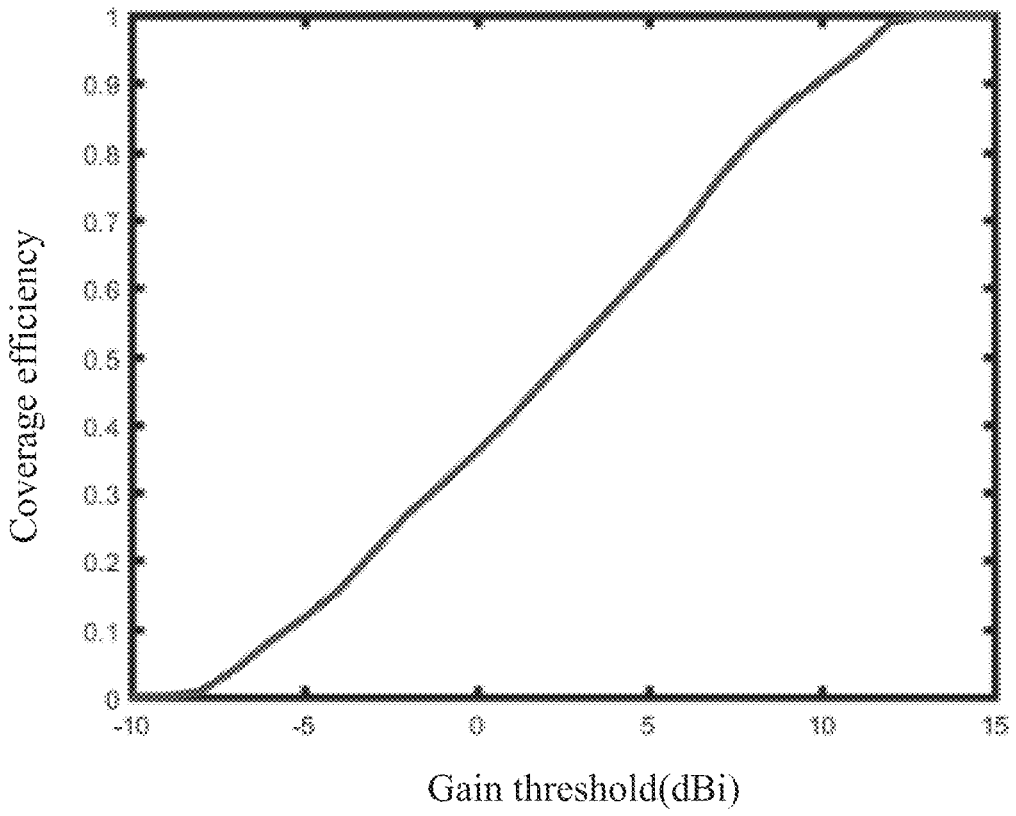
FIG. 7B illustrates a coverage efficiency graph of an antenna-in-package system according to the present disclosure in a band of 39 GHz.

FIG. 7A illustrates a coverage efficiency graph of an antenna-in-package system according to the present disclosure in a band of 28 GHz; and FIG. 7B illustrates a coverage efficiency graph of an antenna-in-package system according to the present disclosure in a band of 39 GHz.

It can be seen from FIG. 7A and FIG. 7B in combination, in the band of 28 GHz, a gain threshold of the antenna-in-package system 4 is 10 dBi, and the gain threshold of the antenna-in-package system 4 is reduced by 10 dBi for the case of 50% coverage efficiency, while the gain threshold is reduced by 12.98 dBi for the case of 50% coverage efficiency in the 3GPP discussion; in the band of 39 GHz, the gain threshold of the antenna-in-package system 4 is 13 dBi, and the gain threshold of the antenna-in-package system 4 is reduced by 10 dBi for the case of 50% coverage efficiency, while the gain threshold is reduced by 13.6-18.0 dBi for the case of 50% coverage efficiency in the 3GPP discussion, showing that the AiP antenna system 4 of the present disclosure has the better coverage efficiency.

Compared with the related art, the antenna-in-package system 4 and the mobile terminal 100 provided by the present disclosure have following beneficial effects: the metal antenna 43 includes a first feeding point 101 and a second feeding point 102, and the first feeding point 101 and the second feeding point 102 excite signals of different bands to achieve the dual-band coverage of the antenna-in-package system 4. Moreover, the antenna-in-package system 4 is formed by being laminated by a PCB process or an LTCC process, such that the size is reduced to 18×5 mm and the occupied area is greatly reduced compared with the dual-band antenna system in the related art. The millimeter wave phased array antenna system adopts a linear array instead of a planar array, occupies a narrower space in the mobile phone, and only needs to be scanned in one perspective, which simplifies design difficulty, test difficulty, and beam management complexity.

What have been described above are only embodiments of the present disclosure, and it should be noted herein that those skilled in the art can make improvements without departing from the inventive concept of the present disclosure, but these are all within the scope of the present disclosure.

What is claimed is:

1. An antenna-in-package system, applied to a mobile terminal comprising a main board, the antenna-in-package system comprising:

a substrate;

a metal antenna provided on a side of the substrate facing away from the main board;

an integrated circuit chip provided on a side of the substrate close to the main board; and a circuit provided in the substrate and connected to the main board, the circuit connecting the metal antenna with the integrated circuit chip, wherein the metal antenna is a patch antenna simultaneously fed with power by two feeding points, and the two feeding points are configured to excite electromagnetic waves in different bands;

the two feeding points comprise a first feeding point and a second feeding point, the first feeding point is configured to excite electromagnetic waves in a band of 28 GHz, and the second feeding point is configured to excite electromagnetic waves in a band of 39 GHz;

the antenna-in-package system is formed by being laminated by a LTCC process, and the size of the antenna-in-package system is 18×5 mm.

2. The antenna-in-package system as described in claim 1, wherein each of the two feeding points is connected to the circuit by a feeding probe.

3. A mobile terminal, comprising the antenna-in-package system as described in claim 2.

4. The antenna-in-package system as described in claim 1, wherein the antenna-in-package system is a millimeter wave phased array antenna system.

5. The antenna-in-package system as described in claim 4, wherein the metal antenna is arranged in a one-dimensional linear array and comprises a plurality of metal antenna units, and the plurality of metal antenna units is sequentially arranged at intervals.

6. A mobile terminal, comprising the antenna-in-package system as described in claim 5.

7. A mobile terminal, comprising the antenna-in-package system as described in claim 4.

8. The antenna-in-package system as described in claim 1, wherein the metal antenna is selected from a group consisting of a square patch antenna, a ring patch antenna, a circular patch antenna, and a cross-shaped patch antenna.

9. A mobile terminal, comprising the antenna-in-package system as described in claim 8.

10. The antenna-in-package system as described in claim 1, wherein the substrate is a multilayer high-frequency low-loss plate.

11. A mobile terminal, comprising the antenna-in-package system as described in claim 10.

12. A mobile terminal, comprising the antenna-in-package system as described in claim 1.

* * * * *